United States Patent [19]

Bell et al.

[11] 3,944,120

[45] Mar. 16, 1976

[54] CONSTANT TENSION LOAD-TRANSFERRING APPARATUS AND METHOD

[75] Inventors: Duncan Bell, Everett; Donald A. Swanson, Lynnwood; John P. Veale, Kirkland, all of Wash.

[73] Assignee: Western Gear Corporation, Everett, Wash.

[22] Filed: July 24, 1974

[21] Appl. No.: 491,314

[52] U.S. Cl. ..... 226/4; 226/111; 226/195; 254/173 B

[51] Int. Cl.[2] ..... B65H 17/42

[58] Field of Search ..... 226/4, 108, 111, 112, 116, 226/169, 195; 254/173 R, 173 B

[56] References Cited

UNITED STATES PATENTS

| | | | |
|---|---|---|---|
| 3,119,537 | 1/1964 | Smits | 226/111 |
| 3,155,483 | 11/1964 | Rismondo | 226/111 X |
| 3,549,072 | 12/1970 | Ito | 226/112 |

*Primary Examiner*—Richard A. Schacher
*Attorney, Agent, or Firm*—Seed, Berry, Vernon & Baynham

[57] ABSTRACT

An elongated pipe is held in a first constant tension mechanism and then, while the tension is maintained, the pipe load is shifted to a second constant tension mechanism by automatically correlating the declining tension force of the first constant tension mechanism with the increasing tension force of the second constant tension mechanism until the pipe is completely shifted to the second constant tension mechanism.

11 Claims, 3 Drawing Figures

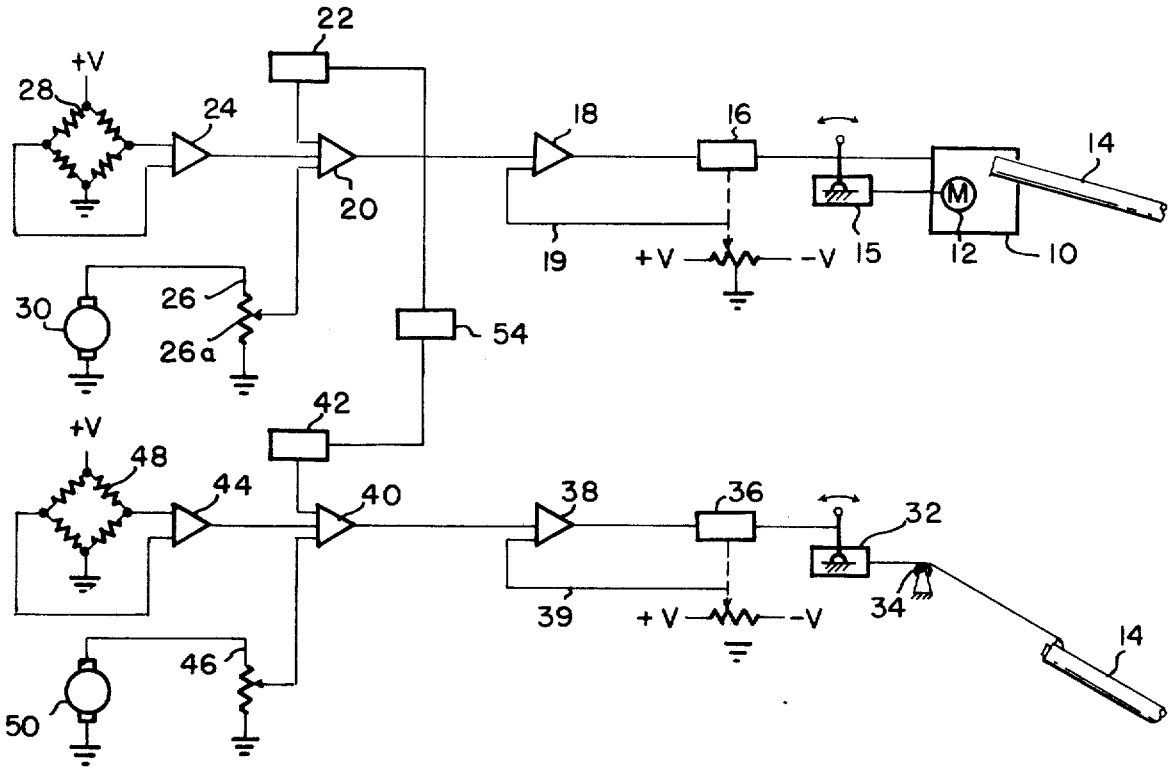
FIG. 1
FIG. 3
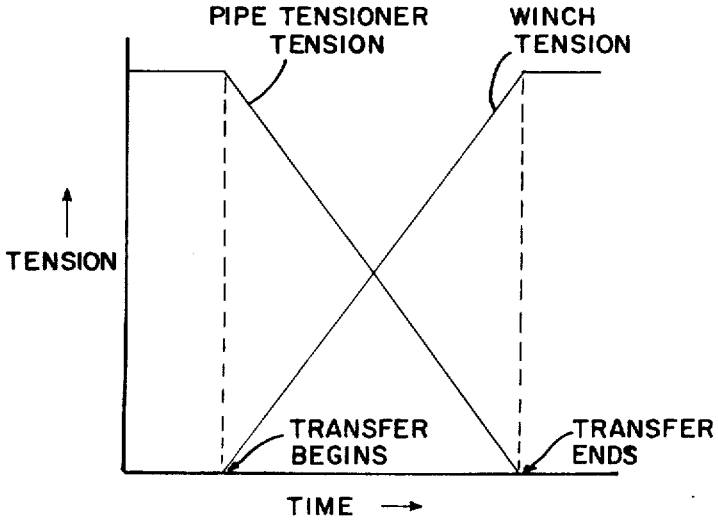

CONSTANT TENSION LOAD-TRANSFERRING APPARATUS AND METHOD

BACKGROUND OF THE INVENTION

Field of the Invention

This invention pertains to constant tension load-transporting mechanisms and, more particularly, to a control for shifting the load between two such mechanisms without effecting a change in the tension on the load.

Description of the Prior Art

A pipeline is normally held on a ship, or barge, by a machine or mechanism called a pipe tensioner. The pipe tensioner carries the pipeline in constant tension such that motion of the ship due to sea movement does not cause the pipeline to be damaged by exceeding the tensile strength of the pipeline or bending it so sharply as to cause buckling.

At certain times in the process of laying the pipeline, it may become necessary to lower the entire pipeline to the bottom of the sea. This may be necessary, for example, because of rough seas. The process is called "abandonment," and the process of picking up the pipeline from the sea bottom is called "recovery."

During abandonment, the pipeline is held in constant tension by the pipe tensioner mechanism or mechanisms. A plug is then secured in the open end of the last section of pipe forward of the pipe tensioner mechanism. To this plug is added a shackle which connects through a wire rope to a constant tension winch.

Since abandonment is normally caused by rough seas, during this condition, there is generally regular, perhaps exaggerated, movement of the pipeline through the tensioner mechanism in order that the tension on the pipeline can be maintained relatively constant. Thus, in attempting to transfer tension from the pipe tensioner to the winch, there is the problem of having two constant tension systems pulling on the same pipeline, with the possibility of instability.

SUMMARY OF THE INVENTION

It is an object of the invention to provide a method for transferring a load from one constant tension mechanism to another constant tension mechanism without substantially varying the tension in the load.

It is another object of this invention to provide an apparatus for transferring a load exclusively from a first load-transporting means to a second transporting means without substantially varying the desired tension in the load.

It is another object of this invention to provide a control for correlating the independent controls of two constant tension load-transporting mechanisms so that a load can be shifted exclusively from one of the mechanisms to the other of the mechanisms automatically and without substantially varying the tension in the load.

Basically, these objects are obtained by the method of applying a first variable tension force on the load while the load is in motion, then applying a second variable tension force on the load, again while the load is in motion, and simultaneously decreasing the first variable tension force while increasing the second variable tension force in substantially identical increments so as to shift the load exclusively from said first variable tension force to said second variable tension force while the load is in motion.

The apparatus objects are obtained by basically providing a control apparatus to correlate the shifting of a load from a first load-transporting mechanism having means for holding a load, first powered means for moving the first holding means along a path to move the load and first control means for varying the velocity and direction of the holding means in order to maintain a desired tension in the load, a second load-transporting mechanism including second means for holding a load, second powered means for moving the second holding means along a path to move the load, and second control means for varying the velocity and direction of the holding means in order to maintain a desired tension in the load, and transfer control means operative for shifting the load exclusively from said first load-transporting means to said second load-transporting means without substantially varying the desired tension in the load.

In the preferred embodiment, the transfer is done automatically by providing an identical timing pulse to each of the first and second control means and, in response to the timing pulse, respectively increasing or decreasing the tension forces in substantially identical increments in opposite directions so that as one load-transporting mechanism reduces its tension on the load, the other load-transporting mechanism increases its tension on the load.

Using the apparatus and method of this invention, any type of load can be shifted between two constant tension devices for various applications other than laying pipeline on an ocean floor. Preferably, however, the invention is best utilized for transferring between two constant tension devices, such as a pipe tensioner of the type shown in U.S. Pat. Nos. 3,669,329 and 3,722,769 and a conventional constant tension winch whose controls are modified in accordance with the teachings of this invention. In this manner, a pipe can be abandoned or recovered while maintaining it under the desired tension and regardless of the extent of wave motion or ship forward movement occurring at the time of the operation.

BRIEF DESCRIPTION OF THE FIGURES OF THE DRAWING

FIG. 1 is a schematic block diagram illustrating the overall system of the invention.

FIG. 3 is a graph illustrating the corresponding tension forces of the two constant tension devices during an abandonment operation.

DESCRIPTION OF THE PREFERRED EMBODIMENTS

Figure 2:
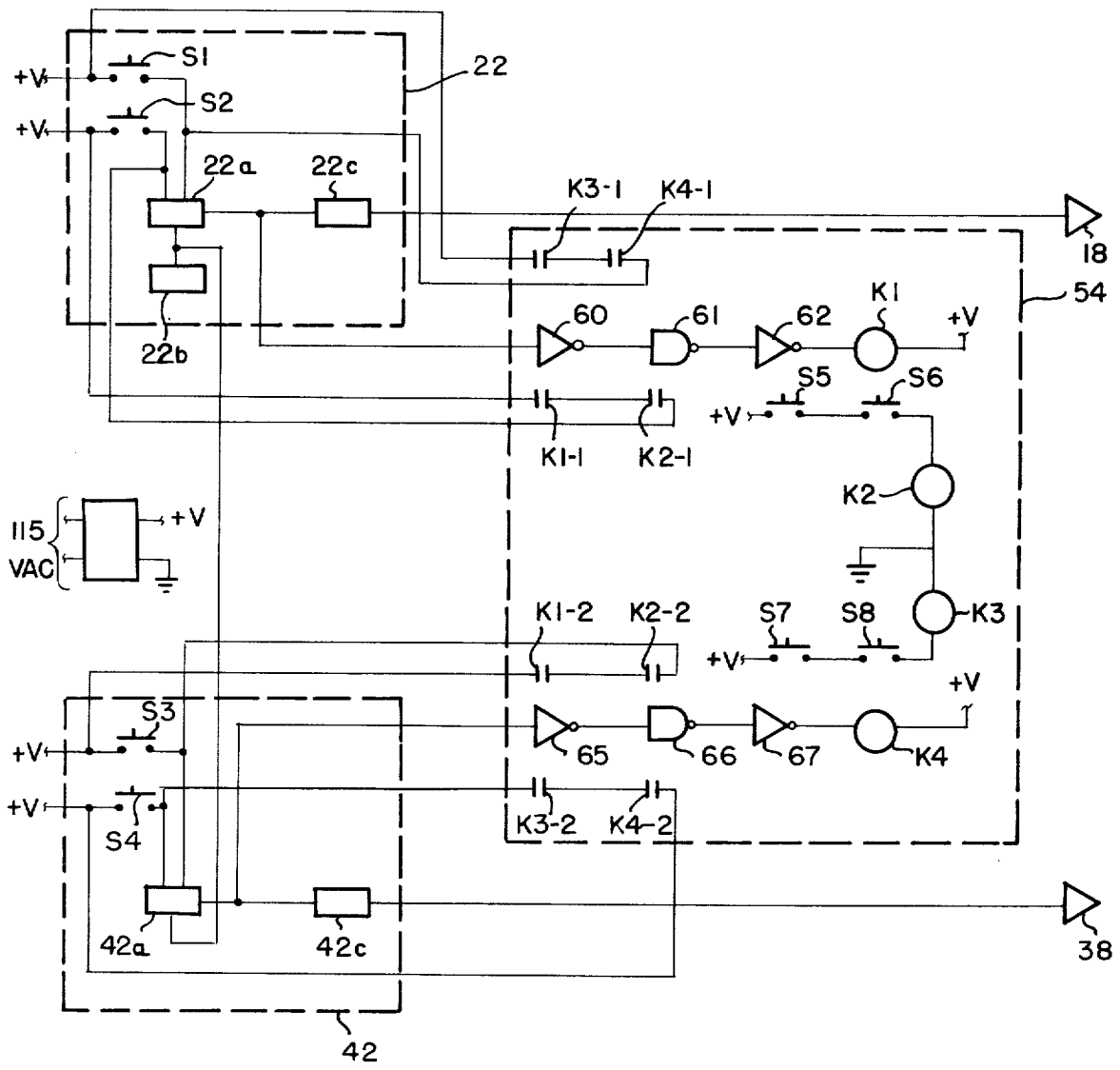
FIG. 2 is a logic diagram illustrating the components of the controls for shifting between the two constant tension devices.

As best shown in FIG. 1, a pipe tensioner 10 of the type shown in U.S. Pat. No. 3,669,329 is provided with a pipe-holding and motor power unit 12 which applies and moves a pipeline 14 for laying the pipeline along the bottom of the sea. As is well known with this type of device, the motor and holding unit 12 can be varied in speed and in direction to maintain a substantially constant tension on the pipeline, generally through a range of several thousand pounds. The upper limit of the range is that tension at which there is a danger of overstressing the pipeline. The lower end of the range is that tension which is insufficient for maintaining a desired catenary in the pipeline, thus raising the possibility of buckling the pipeline. Therefore, the terms "desired tension" or "set tension" are to be understood as referring to an acceptable range of tension forces on the pipeline rather than necessarily implying a single force value.

The holding and motor unit 12 is controlled in speed and direction by a control 15 that is powered by a servo control 16. The servo control is driven by conventional servo control drive circuitry 18 and is provided with a conventional feedback loop 19. The activating signal to trigger the servo control drive circuitry 18 comes from a summing amplifier 20 which receives input signal from a tension set 22, a tension sensing amplifier 24 and a slope control circuit 26. As described in U.S. Pat. No. 3,722,769, the tension sensing amplifier receives its signals from load cells 28 mounted on the pipe tensioner 10. The slope control circuit 26 transmits to summing amplifier 20 an adjustable percentage of the signal from a tachometer 30 which measures the velocity of the pipe through the tensioner 10. As thus far described, the circuitry is substantially identical to that described in U.S. Pat. No. 3,722,769.

An abandonment and recovery constant tension winch 32 is provided with a sheave 34 containing the conventional instrumentation necessary to control the winch to provide constant tension. The speed of the winch is also controlled by a conventional servo control 36, a servo control drive circuitry 38 and a conventional feedback loop 39. Signals to the servo control drive circuitry are transmitted from a summing amplifier 40 which receives its inputs from a tension set 42, a tension sensing amplifier 44 and a slope control circuit 46. The tension sensing input is derived from load cells 48 present in the sheave 34, and a tachometer 50 measures the rotational movement of the sheave 34 for determining the speed input. In addition, the sheave instrumentation contains a footage counter to measure the length of rope or cable paid out. The circuitry and control of the winch in constant tension are substantially identical to the circuitry and control described in U.S. Pat. No. 3,722,769.

The strain gauges of the load cell 28 sense the tension which the pipe exerts upon the pipe tensioner mechanism 10. This tension signal is amplified through the instrumentation for tension sensing amplifier 24 where it is then summed in amplifier 20 with the tension set input and the slope or speed signal input. The tension set signal is the tension selected by the operator for laying the pipe. Therefore, if the speed control signal from 26 is ignored, the output of amplifier 20 will be zero if the signals from tension set 22 and amplifier 24 are equal in magnitude but opposite in polarity. Under this condition, the tension selected by the operator and the tension actually exerted by the pipe tensioner are equal.

When the tension on the pipe varies from the desired tension as selected by the tension set 22, the speed of the pipe must be reduced or increased to correct the variance in tension. In order to modify the pipe speed, the mass of the pipe must be accelerated, thereby requiring a modification in force exerted on the pipe by the pipe tensioner mechanism 10. The force will be equal to the product of the pipe mass and the pipe acceleration. Because acceleration is the first derivative of speed with respect to time, and force is equal to the product of mass and acceleration, the tension or force on the pipe is proportional to the first derivative of the speed of the pipe. Thus, any change in the tension on the pipe will be reflected by a change in speed of the pipe tensioner in order to compensate for the change in tension. Therefore, a change in tension will be reflected by a change in voltage from the tachometer 30. This speed signal is fed to amplifier 20 as positive feedback. For example, when an increase in pipe tension occurs, the speed of the pipe tensioner will increase in order to reduce the excess tension. As a result of this increase in speed, the voltage at the output of tachometer 30 will increase, thereby increasing the voltage at the output of slope control 26 by an amount which is a function of the slope control setting. Since the feedback is positive, a voltage increase in the speed control signal will increase the voltage at the output of amplifier 20 to further increase speed. However, the voltage contributed by the slope input from 26 must always remain less than that contributed by the tension difference for maximum demand from lines 22 and 24 in order for the system to be stable. Thus, the time response of the pipe tensioner as a function of pipe tension can be modified by adjusting slope control 26. In this manner, the response characteristics of the system can be varied to adjust for the optimum pipe slope for the particular set of circumstances under which the pipe is being laid.

The servo control drive circuitry 18 and 19 positions the servo control 16, which thereafter controls the speed of the pipe tensioner. With a zero input signal to the servo control drive circuit, the output to the servo control maintains the servo control in its present position. Whenever a plus or minus error signal is present on the output of the summing junction amplifier 20, the control drive circuitry 18 will provide an output which drives the servo control 16 until the feedback 19 contributes a voltage equal in magnitude but opposite in polarity to the error signal at the summing junction 20. The net input into 18 is, therefore, zero.

The abandonment winch circuitry performs identically to the pipe tensioner as described.

The improvement of this invention is to interconnect the control circuits from the tensioner and the abandonment winch to correlate their operation so that they synchronously operate to shift the tension between one to the other. For this purpose, tension control transfer circuitry 54 (FIG. 1) is provided and the tension set signals from the pipe tensioner tension set 22 and the abandonment winch tension set 42 are fed into this transfer circuitry 54. The details of the transfer set circuits and the tension control transfer circuit are best shown in FIG. 2. Each of the set circuitries includes an up/down counter 22a and 42a, respectively. Both counters are clocked from the clock 22b in the tension set 22 and produce a 12-bit binary output, of which only one bit is shown for simplicity. Both counters count up upon actuation of tension increase switches S1 and S3 and down upon the actuation of the tension decrease switches S2 and S4. The count is stopped upon release of the switches. During abandonment or recovery, up/down counters **22*a* and 42*a*** will be counting in opposite directions.

Digital/analog converters **22*c* and 42*c* convert the digital output of the counters to an analog signal for input to the respective servo control drive circuitry 18 or 38. As shown in FIG. 3,** the analog signal will be a linear "ramp," and the slope of one analog signal will be positive and the slope of the other analog signal will be negative.

In order to transfer the tension being applied by the pipe tensioner to the winch, it is necessary to relieve the tension from the pipe tensioner at the same time and by the same amount that it is being acquired by the winch. In order to perform this transfer, abandonment switch S5 and transfer switch S6 are closed. Closing of switches S5 and S6 energizes relay K2, thus closing contacts K2-1 and K2-2. Although relays are illustrated in the preferred embodiment, it should be understood that solid-state switches may be used as well. Relay K1 is continually energized until a zero count is reached on the up/down counter 22a. Thus the contacts K1-1 and K1-2 will remain closed until a zero count is reached. When a zero count is reached, each bit of the 12-bit digital output ("0") is separately inverted by inverter 60 (and other inverters not shown) and is fed into a twelve-input NAND gate 61 from where the output ("0") is inverted by inverter 62, subsequently deenergizing relay K1 and opening the contacts K1-1 and K1-2 and thus stopping counter 22a from counting down (decreasing tension) and counter **42*a*** from counting up (increasing tension). Once this has taken place, there is no more tension being taken by the pipe tensioner and the full load is handled by the winch.

In order to transfer the tension being held by the winch to the pipe tensioner, the reverse process takes place. Tensioner switch S7 and transfer switch S8 are simultaneously depressed, energizing relay K3, thus closing contacts K3-1 and K3-2. Relay K4 is continuously energized until counter 42a has counted down to zero. Relay K4 is then deenergized through inverter 65, NAND gate 66 and inverter 67. Once the contacts K4-1 and K4-2 are opened, counter **22*a* stops counting up and counter 42*a*** stops counting down, at which time there is no longer any tension on the winch.

As is readily apparent, the transfer control circuitry enables the ready shift of tension between two of the constant tension devices without effecting the tension being carried by the pipe. While the preferred embodiment of the invention has been illustrated and described, it should be understood that variations will be apparent to one skilled in the art without departing from the principles herein. Accordingly, the invention is not to be limited to the specific embodiment illustrated.

The embodiments of the invention in which a particular property or privilege is claimed are defined as follows:

1. Control apparatus for shifting tensioned loads between two load-transporting mechanisms, comprising;

a first load-transporting mechanism including first means for holding a load, first powered means for moving the first load-holding means along a path to move the load, and first control means for varying the velocity and direction of the first load-holding means in order to maintain a desired tension in the load, a second load-transporting mechanism including second means for holding a load, second powered means for moving the second load-holding means along a path to move the load, and second control means for varying the velocity and direction of the second load-holding means in order to maintain a desired tension in the load, and transfer control means operative for shifting the load exclusively from said first load-transporting mechanism to said second load-transporting mechanism without substantially varying the desired tension in the load.

2. The apparatus of claim 1, said first control means including a first tension increase mode and a first tension decrease mode, said second control means including a second tension increase mode and a second tension decrease mode, said transfer control means including first shift means for simultaneously operating said first control means in tension decrease mode and said second control means in tension increase mode whereby the load will be transferred exclusively from the first load-transporting means with a declining tension force while being received by the second load-transporting means at an ascending tension force corresponding to said declining tension force.

3. The apparatus of claim 2, said transfer control means including:

means for generating a first tension control signal adapted to control the tension on said first load-holding means in proportion thereto;

means for generating a second tension control signal adapted to control the tension on said second load-holding means in proportion thereto;

means for simultaneously decreasing the value of said first tension control signal and increasing the value of said second tension control signal; and means for simultaneously terminating the decrease in value of said first tension control signal and the increase in value of said second tension control signal when said first tension control signal falls to a predetermined value.

4. The apparatus of claim 3 wherein the value of said first tension control signal plus the value of said second tension control signal is substantially constant.

5. The apparatus of claim 4, said transfer control means including:

a clock for generating a plurality of uniformly spaced pulses;

a first presettable counter adapted to decrement in response to pulses generated by said clock;

a second counter adapted to increment in response to pulses generated by said clock;

a first digital-to-analog converter for generating a first tension control signal, the value of which is proportional to the binary output of said first counter;

a second digital-to-analog converter for generating a second tension control signal, the value of which is proportional to the binary output of said second counter;

means for simultaneously enabling said first counter to count downward from a predetermined number and said second counter to count upward from zero; and means for simultaneously disabling said counters from counting clock pulses when the binary output of said first counter reaches a predetermined value.

6. The apparatus of claim 5 wherein the value of the sum of said first and second tension control signals can be modified by independently modifying the number in said counters.

7. A method for shifting tension loads between two load-transporting mechanisms, comprising;

gradually reducing the load forces on a first load-transporting mechanism; and gradually increasing the load forces on a second load-transporting mechanism at a rate which causes the total forces on said first and second load-transporting mechanisms to be substantially constant.

8. The method of claim 7, including the steps of:

generating a plurality of uniformly spaced pulses;

presetting a first counter to a predetermined value;

decrementing said first counter one unit in response to each of said pulses when said first counter receives an enabling signal;

incrementing a second counter one unit in response to each of said pulses when said second counter receives an enabling signal;

manually initiating an enabling signal, thereby allowing said first counter to decrement and said second counter to increment;

converting the outputs of said counters to an analog voltage, the value of which is proportional to the binary output of said counters;

producing a load force on one of said load-transporting mechanisms which is proportional to the value of one of said analog voltages and producing a load force on the other of said load-transporting mechanisms which is proportional to the value of the other of said analog voltages; and sensing when the binary output of said first counter reaches a predetermined value and terminating said enabling signal in response thereto.

9. A constant tension load-transferring apparatus comprising:

a first load-supporting mechanism connected to said load including means for exerting a first axial force on said load for alternately paying out and retracting said load;

a second load-supporting mechanism connected to said load including means for exerting a second axial force on said load for alternately paying out and retracting said load; and tension control means for gradually increasing said first force while gradually decreasing said second force and for maintaining the sum of said first and second forces substantially constant, whereby the tension in the load is substantially constant during the transfer.

10. The apparatus of claim 9 wherein said first force is a predetermined function of time.

11. An apparatus for transferring a length of conduit from a first conduit-supporting mechanism to a second conduit-supporting mechanism while maintaining the tension of said conduit substantially constant while the conduit is suspended from a vessel and is subjected to wave action and other dynamic forces, said apparatus comprising:

transfer control means including means for generating a first desired tension signal which changes as a function of time from a value indicative of a preset tension in the conduit to a value indicative of substantially zero tension in the conduit, said transfer control means further including means for generating a second desired tension signal indicative of the present tension minus the tension indicated by said first desired tension signal;

first tension sensing means for measuring the axial force exerted on said conduit by said first conduit-supporting mechanism and generating a first actual tension signal indicative thereof;

second tension sensing means for measuring the axial force exerted on said conduit by said second conduit-supporting means and generating a second actual signal indicative thereof;

first comparator means for comparing said first actual tension signal to said first desired tension signal;

second comparator means for comparing said second actual tension signal to said second desired tension signal;

first powered means associated with said first conduit-supporting mechanism and responsive to said first comparator means for paying out said conduit when said first actual tension signal is greater than said first desired tension signal and for retracting said conduit when said first actual tension signal is less than said first desired tension signal; and second powered means associated with said second conduit-supporting mechanism and responsive to said second comparator means for paying out said conduit when said second actual tension signal is greater than said second desired tension signal and for retracting said conduit when said second actual tension signal is less than said second desired tension signal, whereby said conduit-supporting mechanisms pay out and retract conduit in response to said wave action and other dynamic forces, thereby maintaining the tension of said conduit substantially constant during the transfer.

* * * * *